US011078641B2

(12) United States Patent
Gagliano

(10) Patent No.: US 11,078,641 B2
(45) **Date of Patent: *Aug. 3, 2021**

(54) FOUNDATION INTEGRAL CONSTRUCTION COMPONENTS AND SUPPORT SYSTEMS

(71) Applicant: Richard J. Gagliano, Gig Harbor, WA (US)

(72) Inventor: Richard J. Gagliano, Gig Harbor, WA (US)

(73) Assignee: Richard J. Gagliano, Gig Harbor, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,955

(22) Filed: Nov. 5, 2018

(65) Prior Publication Data

US 2019/0136481 A1 May 9, 2019

Related U.S. Application Data

(60) Provisional application No. 62/582,130, filed on Nov. 6, 2017.

(51) Int. Cl.

| | |
|---|---|
| ***E02D 27/50*** | (2006.01) |
| ***E02D 27/12*** | (2006.01) |
| ***E02D 5/22*** | (2006.01) |

(52) U.S. Cl.

CPC ..... *E02D 27/50* (2013.01); *E02D 5/22* (2013.01); *E02D 27/12* (2013.01); *E02D 2300/0026* (2013.01)

(58) Field of Classification Search

CPC ..... E02D 27/14; E02D 27/12; E02D 27/16; E02D 27/40; E02D 27/50; E02D 5/22; E02D 5/54; E02D 5/80; E02D 5/223; E04H 12/223

USPC ..... 405/231, 229; 52/155, 292, 158

See application file for complete search history.

(56) References Cited

U.S. PATENT DOCUMENTS

| | | | | |
|---|---|---|---|---|
| 213,932 A * | 4/1879 | Powell | E02D 5/80 | 52/155 |
| 1,808,633 A * | 6/1931 | Carver | E02D 5/80 | 52/158 |
| 2,001,719 A * | 5/1935 | Greene | E04H 12/223 | 52/158 |
| 2,826,281 A * | 3/1958 | Johnson | E02D 27/50 | 52/158 |

(Continued)

OTHER PUBLICATIONS

International Search Report and Written Opinion dated Feb. 11, 2019 by the International Searching Authority.

*Primary Examiner* — Kyle J. Walraed-Sullivan

(74) *Attorney, Agent, or Firm* — Troutman Pepper Hamilton Sanders LLP

(57) ABSTRACT

Foundation integral construction components and support systems where multiple pile foundation components are incorporated into a structure system that is connected to, or otherwise part of the foundation, can further reduce the need for excavation and thus preserve existing contours and drainage properties of the land. These multiple pile foundation systems, are applicable to a wide variety of site and soil conditions and a wide variety of surface structures or buildings. The multiple pile foundation system can reduce the need for site excavation, drainage control, and soil backfill by transferring load from a portion of a structure to the ground.

7 Claims, 12 Drawing Sheets

(56) References Cited

U.S. PATENT DOCUMENTS 3,195,696 A * 7/1965 Stefan ..... E04H 12/223 52/158
3,195,697 A * 7/1965 Case ..... E04H 12/223 52/158
3,830,457 A * 8/1974 Stewart ..... E04B 1/34347 248/499
4,342,179 A * 8/1982 Hill ..... E02D 5/80 52/155
4,429,849 A * 2/1984 Maier ..... E04G 21/1833 248/156
4,452,018 A * 6/1984 Hill ..... E02D 5/80 52/155
4,937,989 A * 7/1990 Miyares ..... B66F 7/14 182/182.1
5,039,256 A 8/1991 Gagliano
5,243,795 A * 9/1993 Roberts ..... E02D 27/00 405/244
5,372,457 A * 12/1994 Rante ..... E02B 11/005 248/87
5,395,184 A 7/1995 Gagliano
5,649,690 A * 7/1997 Kilmer ..... E04H 12/2223 248/156
5,791,635 A * 8/1998 Hull ..... E04H 17/22 248/156
5,797,226 A * 8/1998 MacKarvich ..... E04B 1/34347 52/155
5,873,679 A * 2/1999 Cusimano ..... E02D 27/48 405/229
6,578,333 B1 * 6/2003 Gagliano ..... E02D 27/01 249/34
6,871,455 B1 * 3/2005 Cockman ..... E02D 5/801 135/118
7,571,577 B2 * 8/2009 Nanayakkara ..... E04H 9/10 14/73.5
8,714,881 B2 * 5/2014 Gagliano ..... E02D 5/22 405/231
2003/0084630 A1 * 5/2003 Shotton ..... E02D 27/14 52/293.1
2004/0025450 A1 2/2004 Gagliano
2005/0025577 A1 2/2005 Gagliano et al.
2005/0238441 A1 * 10/2005 Gagliano ..... E02D 27/02 405/229
2007/0193213 A1 * 8/2007 Nanayakkara ..... E04H 9/10 52/750
2009/0003938 A1 1/2009 Nishimor
2012/0096778 A1 * 4/2012 Bauletti ..... E04H 12/2215 52/155
2012/0003051 A1 5/2012 Plotkin
2013/0272802 A1 10/2013 Gagliano
2014/0083025 A1 * 3/2014 Richardson ..... E02D 31/002 52/126.1
2014/0119838 A1 * 5/2014 Perko ..... E02D 5/56 405/252.1
2014/0161538 A1 * 6/2014 Meggitt ..... E02D 5/80 405/225
2014/0174003 A1 * 6/2014 Despotellis ..... E02D 31/002 52/169.13
2015/0211200 A1 7/2015 Nishioka et al.
2015/0292228 A1 * 10/2015 Bardelli ..... E04H 12/2215 52/165
2016/0281907 A1 * 9/2016 Perko ..... F16M 9/00
2017/0233972 A1 * 8/2017 Zhou ..... E02D 5/80 52/155
2018/0087231 A1 * 3/2018 Masula ..... E02D 5/54
2019/0136481 A1 * 5/2019 Gagliano ..... E02D 27/50

* cited by examiner

FIG 4A
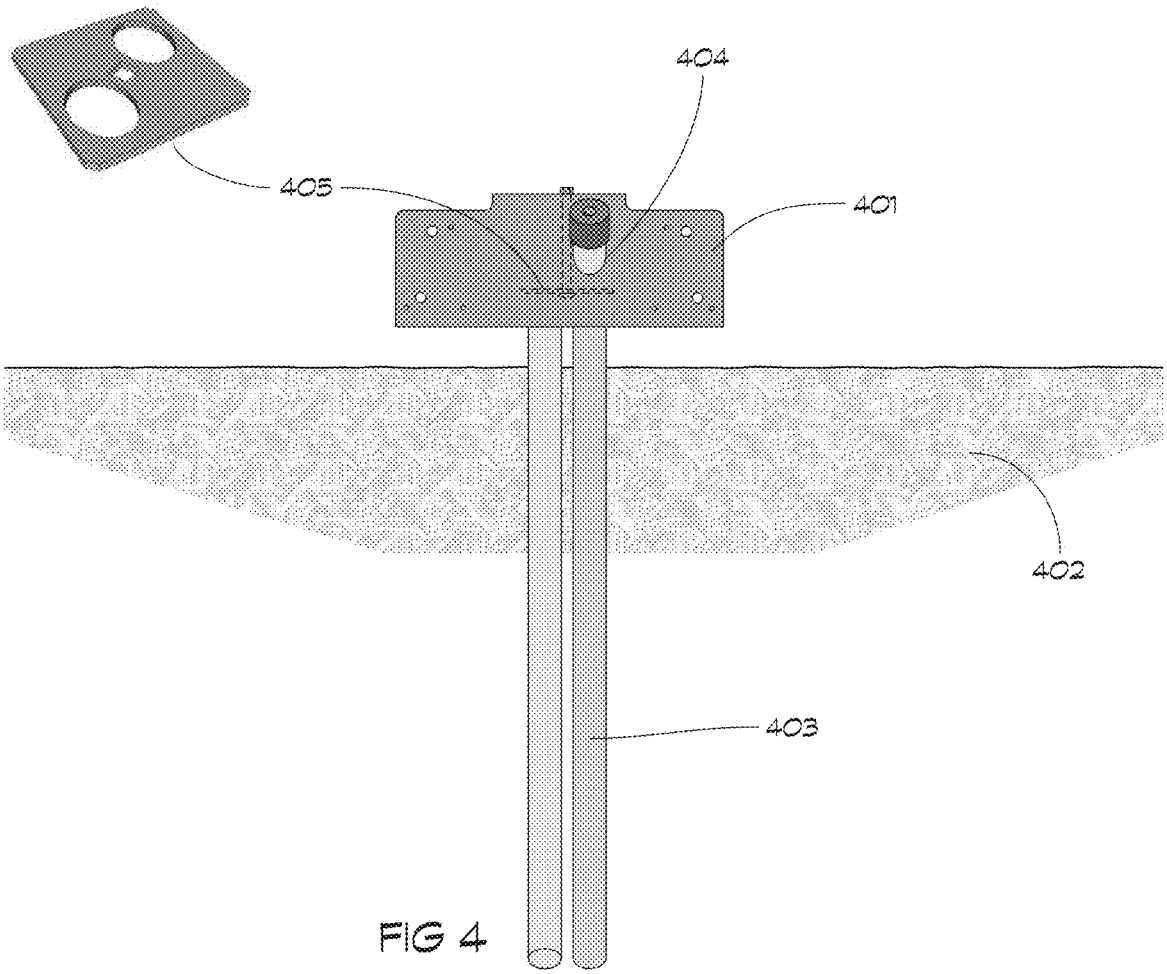
FIG 4
FIG 4B
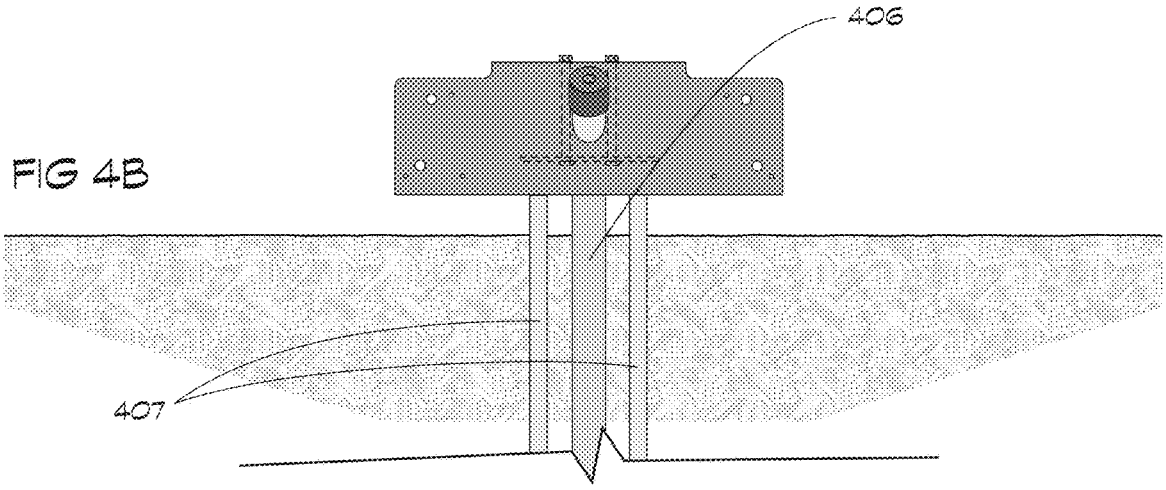

FOUNDATION INTEGRAL CONSTRUCTION COMPONENTS AND SUPPORT SYSTEMS

CROSS-REFERENCE TO RELATED APPLICATIONS

This application claims priority to U.S. Provisional Application No. 62/582,130, filed on Nov. 6, 2017, the disclosure of which is herein incorporated by reference in its entirety.

TECHNICAL FIELD

The invention relates to materials and methods for providing various low environmental impact foundation components and systems for structural support.

BACKGROUND

The search for less expensive, more effective, and more environmentally sound methods of creating building foundations for new construction on previously undisturbed or undesirable building sites has led to the development of the pinned foundation system and structure load transfer systems. These systems are an important advance in foundation engineering and have expanded the availability of and minimized construction impacts on many sites for surface structures.

These multiple pile foundation systems, are applicable to a wide variety of site and soil conditions and a wide variety of surface structures (buildings). The multiple pile foundation system can reduce the need for site excavation, drainage control, and soil backfill by transferring load from a portion of a structure to the ground.

There is a need for foundations that have minimal environmental impact in many areas. The effects of site manipulation on undisturbed soil are permanent and not restricted to the individual sites on which they occur. Altering a site with the use of large machinery, extensive excavation and fill techniques, and the resulting redirection of drainage patterns and water tables damages the biological make up, structural integrity, and pre-existing drainage characteristics of the site, the soil, and its surroundings. This in turn can have damaging effects "downstream", where the accumulation of unwanted eroded material in streambeds can alter plant and animal habitats.

There is therefore a need to minimize excavation in all construction sites, particularly those in sensitive ecosystems, areas with a high-water table or poor soil drainage, or areas in which flooding is repetitive. Challenges transferring load from buildings to the soil in such construction sites is common and the present invention was developed to fulfill these objectives.

U.S. Pat. Nos. 5,395,184 and 8,714,881 are incorporated by reference herein.

SUMMARY OF THE INVENTION

The inventor has found that incorporating multiple pile foundation components into structure system that is connected to, or otherwise part of the foundation, can further reduce the need for excavation and thus preserve existing contours and drainage properties of the land.

In one aspect is provided a foundation system comprising a support frame and a plurality of foundation components connected to the frame at selectively spaced intervals for support of a building. The frame extends in a substantially horizontal or level direction to provide load support to a building structure connected thereto. Each foundation component comprises one or more openings configured to receive and fixedly engage an angularly driven pile. The openings are positioned within the foundation component to define an angular relationship between the component, support frame and one or more piles.

Yet another aspect is provided a foundation system comprising a beam, a plurality of foundation components, and at least one pile connected to each component. The beam is a substantially horizontal element of a foundation and the beam provides support, shape, seat, and attachment to a building structure attached thereto. The plurality of foundation components comprises a beam-engaging shaped metal housing with a plurality of selectively positioned openings. At least one of the openings is configured to receive a pile and the support component is connected to the beam. The pile is positioned through the opening of the foundation component.

Yet another aspect is provided a foundation system comprising a beam, at least one pile connected to the beam, and a locking component configured to be connected to the beam. The beam is a substantially horizontal or level component of a foundation configured to provide level load support to a structure wherein said load includes weight and natural forces, including wind, heave, seismic, and flooding forces. At least one pile connected to the beam is positioned through the opening of the beam. The locking component configured to be connected to the beam comprises a tightening mechanism operable to develop a compression force between said locking component and said pile(s).

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention.

BRIEF DESCRIPTION OF THE DRAWINGS

The figures depict one or more implementations of the inventive devices, by way of example only, not by way of limitation.

FIG. 4 is a front view of a foundation integral beam support or foundation integral saddle support component (401) installed in a suitable soil (402). The beam support component is a rectangular structural steel tube engaged with multiple driven piles (403) through elliptical holes (404) cut in the tube and incorporating an internal locking plate illustrated in FIG. 4A as (405). FIG. 4B illustrates an embodiment in which micro-piles (407) are driven through a support tube and internal locking plate.

DETAILED DESCRIPTION

Figure 1:
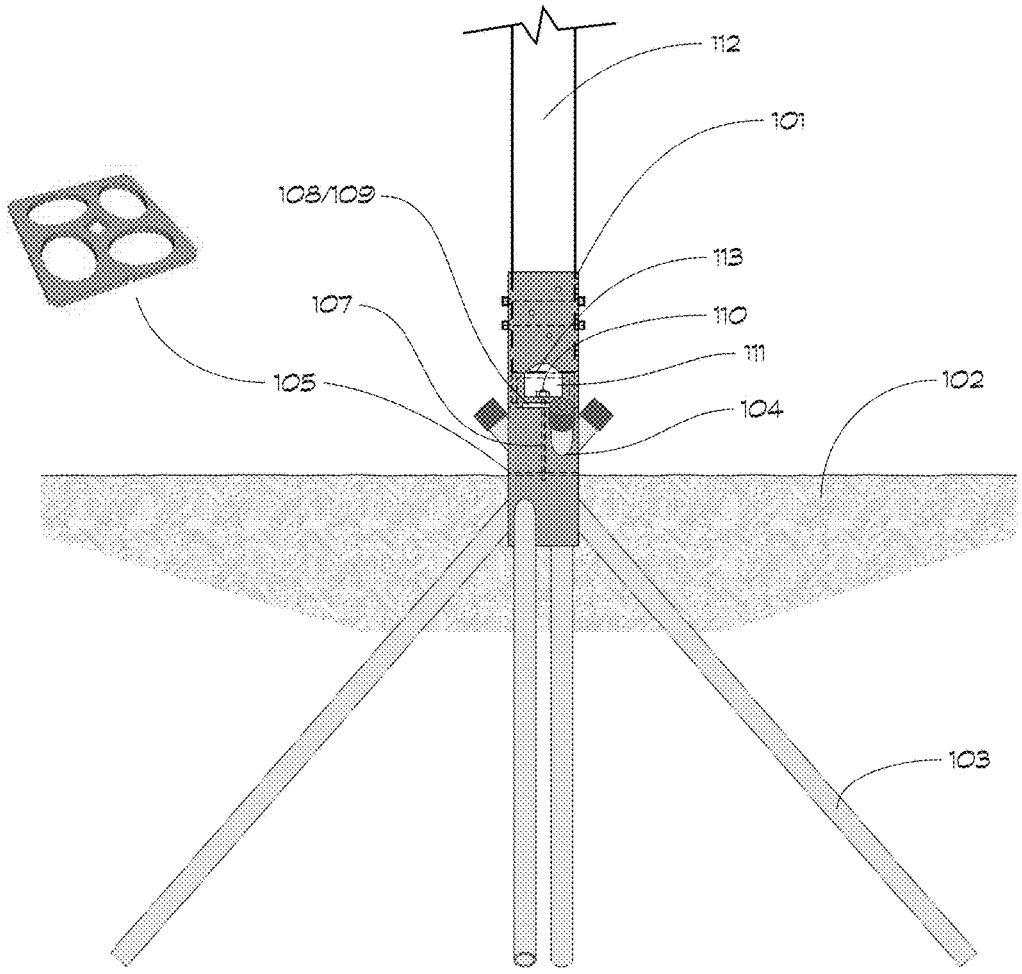
FIG. 1 is a front view of a foundation integral column component (101) installed in a suitable soil (102). The column component is a square structural steel tube (101) engaged with multiple driven piles (103) through elliptical holes (104) cut in the tube, for example as illustrated in FIG. 9 of U.S. Pat. No. 5,395,184, which is incorporated by reference herein, and incorporating an internal locking plate (105), for example as illustrated in U.S. Pat. No. 8,714,881, which is incorporated by reference herein.

In one aspect is provided a foundation integral support system comprising a supporting frame and a plurality of foundation components connected to the frame elements at selectively spaced intervals for support thereof. The frame extends in a substantially horizontal or level direction to provide load support to a building structure connected thereto. Each support component comprises one or more openings configured to receive and fixedly engage an angularly driven pile. The openings are positioned within the foundation component to define an angular relationship between the foundation component, support frame and one or more piles.

In various embodiments, the foundation integral support system can reduce the need for site excavation, drainage control, and soil backfill by transferring load from one or multiple portions of a structure to the ground without digging. The foundation systems are minimal excavation foundations, also known as low impact foundations, or are part of minimal excavation foundations or low impact foundations. A minimal excavation foundation is a building best management practice (BMP) that minimizes mass grading and site disturbance by distributing a building's structural load onto piles. The foundation integral support systems described herein can reduce runoff and improve water quality by not substantially requiring stormwater management systems. When stormwater is absorbed into soil, it is filtered and ultimately replenishes aquifers or flows into streams and rivers with minimal downstream flooding, stream bank erosion, increased turbidity (muddiness created by stirred up sediment) from erosion, habitat destruction, contaminated streams, rivers, and coastal waters. In summary, the foundation integral support systems reduce the need to grade land, minimize soil compaction arising from use of heavy excavation equipment, and preserves the natural flows of stormwater.

Any number of foundation integral components illustrated herein may be used. The component can comprise, for example, a locking plate comprising one or more openings having an inner perimeter formed as a non-circular ellipse and configured to receive the pile. A nonlimiting example of a locking plate is shown in FIG. 1A as (105).

In various embodiments, the foundation integral construction components comprise (i) a top plate or surface in any orientation available as long as its configured to enable the locking function; (ii) a locking component configured to be connected to said top plate or surface by one or more connectors, comprising a tightening mechanism operable to develop a compression force between said top plate or surface and said locking component, in which the locking component is configured to lock the pile within the one or more openings when the tightening mechanism is utilized such that the distance between the top plate or surface and the locking component is reduced by the compression force thereby locking the pile in the one or more openings.

In various embodiments, the support frame comprises at least one beam member wherein the at least one beam member is set within one of the foundation components. The beam member can be made of various materials. In one embodiment, the beam member is made of wood.

In various embodiments, the support frame distributes a structural load onto the foundation components and piles. There can be a relationship between the structural load and (i) one or more of the number of foundation components and (ii) the locations of the foundation components.

In yet another aspect is provided a supporting frame system comprising a beam, a plurality of foundation components, and at least one pile connected to each foundation component. The beam is a substantially horizontal or level element of a foundation and the beam provides support, shape, seat, and attachment to a building structure attached thereto. The plurality of foundation components comprises a beam-engaging shaped metal housing or saddle shaped metal housing with a plurality of selectively positioned openings. At least one of the openings is configured to receive a pile and the foundation component is connected to the beam. The pile is positioned through the opening of the foundation component.

In some embodiments, the foundation structural support system comprises two piles. In some embodiments, the two piles are positioned at a predetermined angle relative to the supported structure. The foundation system can comprise two beams, with each of the two beams is set within one of the support components. In various embodiments, the foundation system further comprises a bracing connector configured to connect the foundation component to the beam.

In some embodiments, the beam is horizontal or level or at an angle to the surface of the soil. In various embodiments, the support system distributes a structural load onto the foundation components and integral piles. The positioning of the foundation components and piles may be configured to distribute various loads provided by different soils and building structures. For example, there can be a relationship between the structural load and one or more of the number of foundation components and the locations of the foundation components.

In yet another aspect is provided a foundation system comprising a beam, at least one pile connected to the beam, and a locking component configured to be connected to the beam. The beam is a substantially horizontal or level component of a foundation configured to provide load support to a structure wherein said load includes weight natural forces, including wind, heave, seismic, and flooding forces. At least one pile connected to the beam is positioned through the opening of the beam. The locking component configured to be connected to the beam comprises a tightening mechanism operable to develop a compression force between said beam and said locking component.

In some embodiments, the locking component is configured to lock the pile within the opening when the tightening mechanism is utilized such that the distance between the beam and the locking component is reduced by the compression force, thereby locking said pile in the opening.

The structural support system can be configured to be placed on a hill, on a substantially level or terraced site.

The structural support system can be comprised of wood and steel. Alternatively, the structural support system can be comprised of steel. The beam can be comprised of wood. Alternatively, the beam can be comprised of steel.

EXAMPLES

The present invention is also described and demonstrated by way of the following examples. However, the use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled.

Example 1: Foundation Component Installed in Soil

Figure 1A:
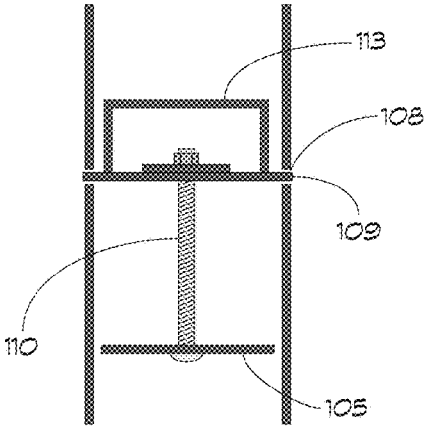
FIG. 1A is an enlarged view of the foundation integral column component showing the internal locking plate (105) supported within the tube in a specific location to facilitate easy sliding of the various piles by a tightening bolt (107) which passes through a resisting plate (108) set within the tube through slots (109).
Figure 9:
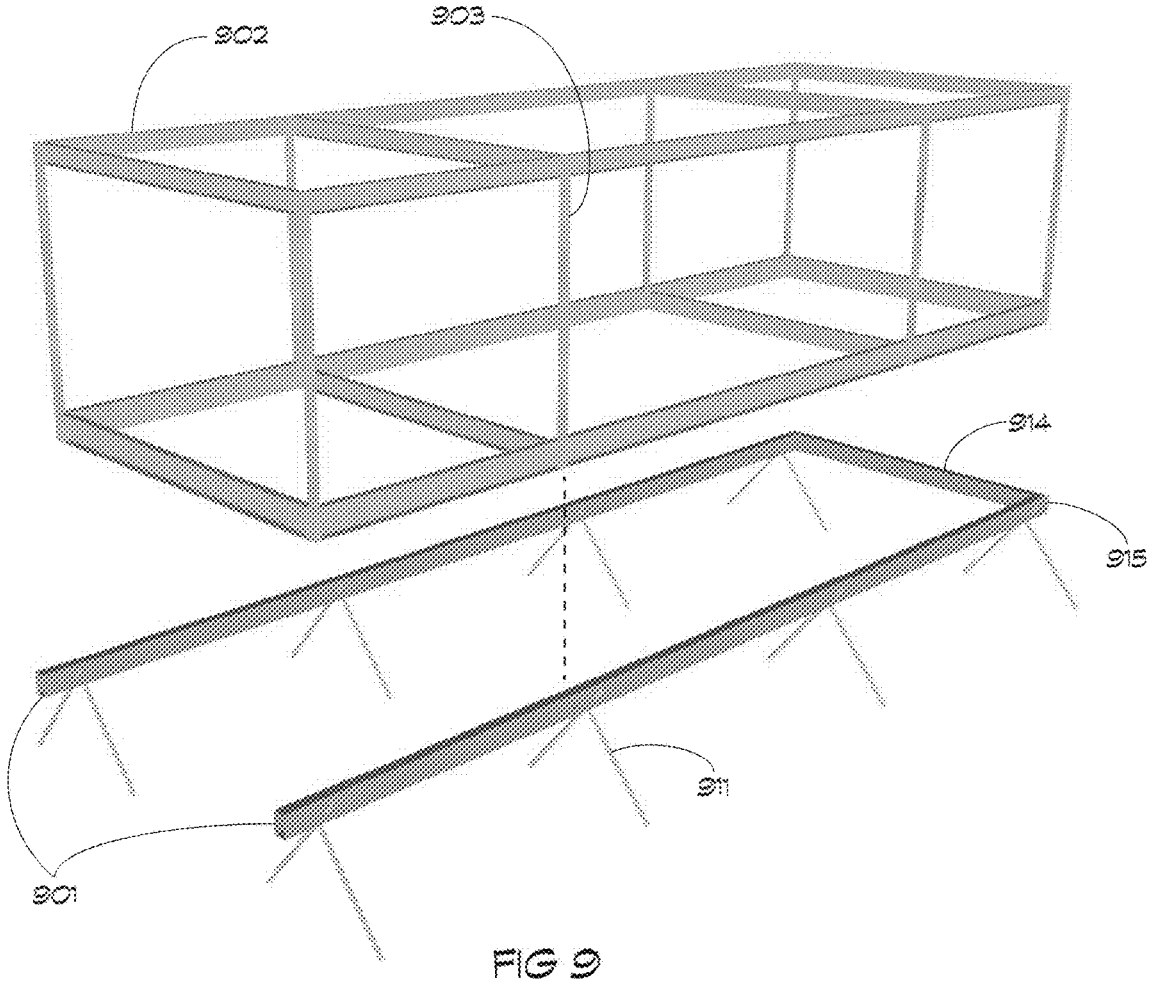
FIG. 9 is a three-dimensional view of an application of two horizontal beam components configured to support a steel frame structure (902), where the pile groups (911) are aligned with column point loads (903) above. An additional beam component (914) is also shown, running perpendicular to the two main beams, closing off the frame. These beams are joined at the corners with a mitered connection (915) which can be welded or bolted to secure.

This exemplary embodiment is illustrated in FIGS. 1, 1A, 1B and 1C. FIG. 1 is a front view of a foundation integral column component (101) installed in a suitable soil (102). The column component is a square structural steel tube (101) engaged with multiple driven piles (103) through elliptical holes (104) cut in the tube, for example as illustrated in FIG. 9 of U.S. Pat. No. 5,395,184, which is incorporated by reference herein, and incorporates an internal locking plate (105), for example as illustrated in U.S. Pat. No. 8,714,881, which is incorporated by reference herein.

In this exemplary installation, the tube component (101) is set substantially plumb within a shallow cavity in a minimally disturbed suitable battered pile bearing soil. Micro-piles driven through the tube and internal locking plate, and into the soils provide structural support in bearing, uplift, rotational, shear and lateral loads. Once the micro piles are driven, the locking plate is tightened to bind the piles against their corresponding elliptical holes in the tube. In the component depicted, the locking plate is supported within the tube in a specific location to facilitate easy sliding of the various piles by a tightening bolt (107) which passes through a resisting plate (108) set within the tube through slots (109). Tightening of the bolt and the consequent binding of the piles is achieved by tightening the nut (110) reached through the access hole (111). Once set the steel column can be further enhanced with the introduction of a wood member (112) sized to slip easily within the tube shape. The wood member rests on a stand-off base (113) configured to separate the wood from the tightening nut while still allowing access to the nut through the access hole.

Figure 1B:
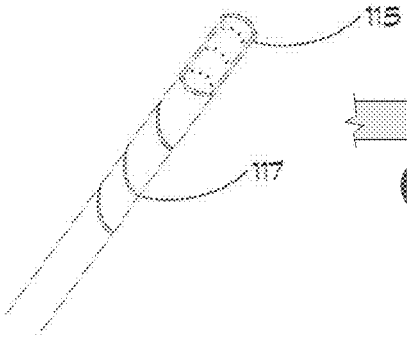
FIG. 1B is an illustration of a pile or micropile with deformations (115) or turnings (117).
Figure 1C:
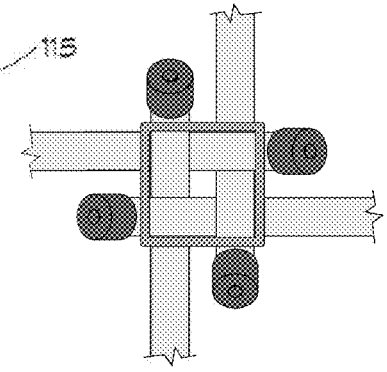
FIG. 1C illustrates a multiple pile group, which may be comprised of 2 or more individual piles, passes substantially below the load axis of the column.

This column component provides various benefits. The benefits include multiple allowable shapes, e.g., rectangular, circular, or other structural tube shapes, such as those described in FIG. 10 of U.S. Pat. No. 5,395,184, incorporated by reference herein. The components can be made of steel or other suitable material without changing the essential function defined above. As with the previous art incorporated by reference, the suitable soils may include any material that will provide a load capacity transfer and can be penetrated by the piles, including those that may require predrilling. The piles can be of a wide variety of cross sections and suitable materials per the prior art as well, and they may also include integral deformations (115) or turnings (117), on their surface or internally, which either improve driving, or load resistance or both, as shown in FIG. 1B.

The multiple pile group may (i) be comprised of two or more individual piles and/or (ii) pass substantially below the load axis of the column (FIG. 1C), each of which can improve the load transfer from the structure above and the performance of the pile configuration.

Figure 2:
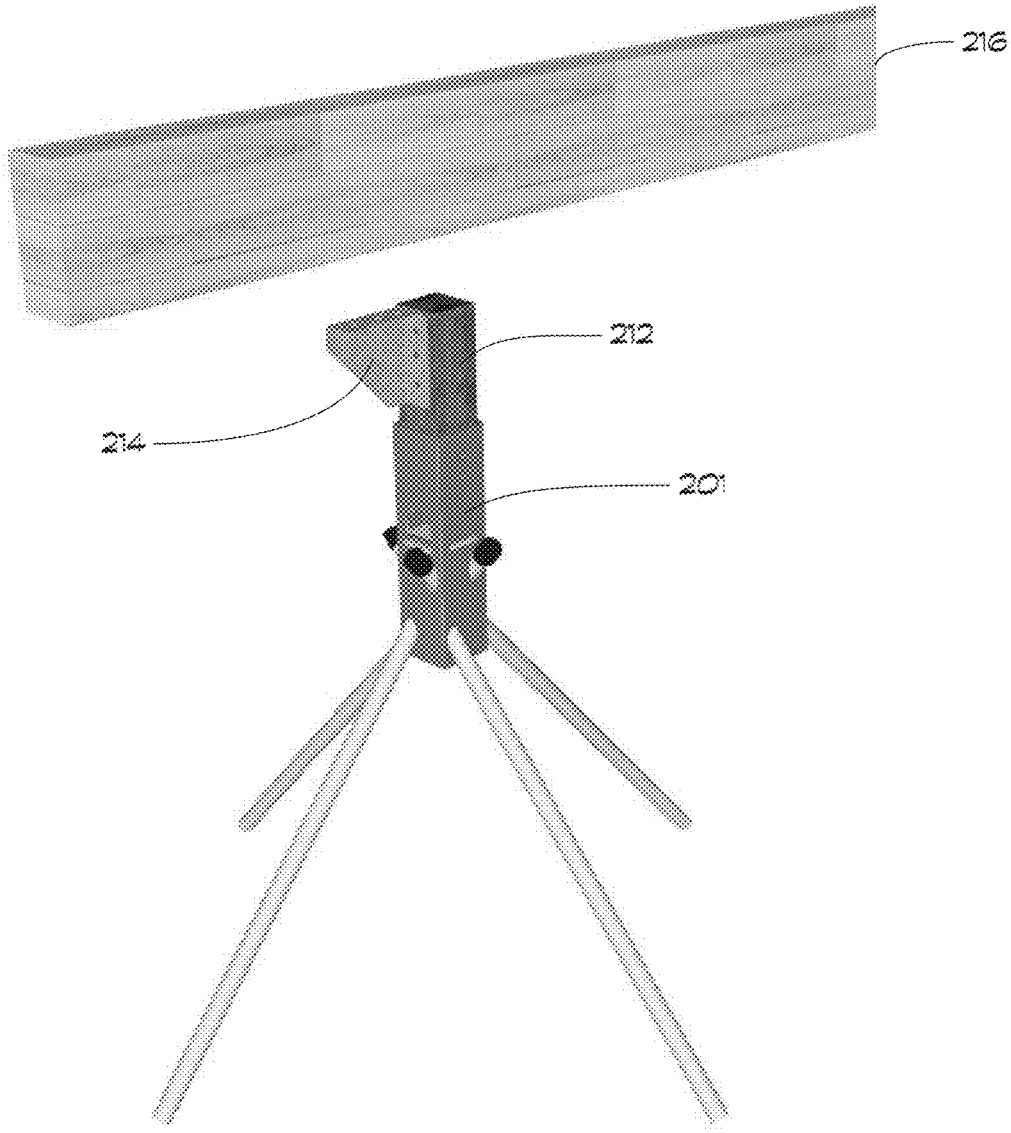
FIG. 2 shows a vertical wood member (212) that effectively extends the height of the foundation integral column (201) and allows for easy working in the field for the overall column component to be cut to proper height, and for screw or bolt attachment of a bracing connector (214) and horizontal sill beam (216).
Figure 2A:
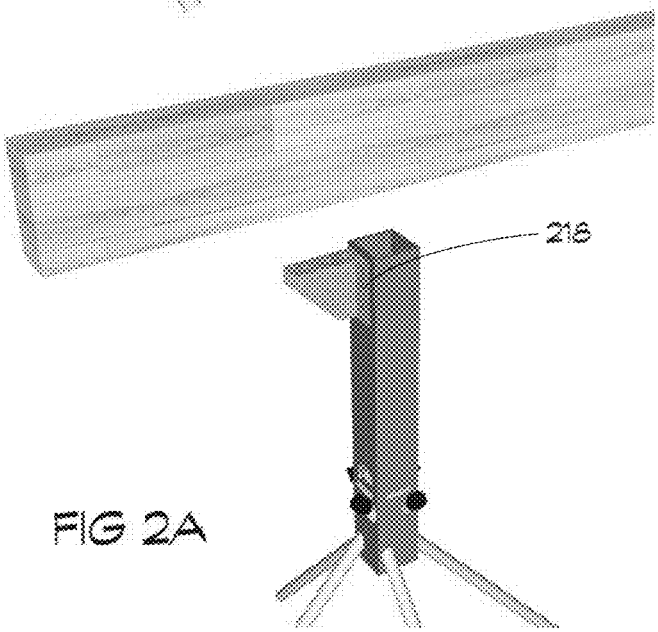
FIG. 2A shows an application in which the steel column component (201) may also simply be fabricated taller than that shown in FIG. 1.

Example 2: Attachment of Horizontal Sill Beam to Foundation Integral Column Component This exemplary embodiment is illustrated in FIGS. 2 and 2A. FIG. 2 shows the vertical wood member (212) (also illustrated as (112) in FIG. 1) effectively extends the height of the foundation integral column and allows for easy working in the field for the overall column component to be cut to proper height, and for screw or bolt attachment of a bracing connector (214) and horizontal sill beam (216). In application the steel column component (201) may also simply be fabricated taller than that shown in FIG. 1, eliminating the wood member entirely, so that the steel rises fully to the horizontal sill beam, also using the bracing connector, but bolted to the steel tube along its vertical edge (218) and attaching with screws or bolts to the horizontal sill beam above. This beam, and the wood column can be glu-laminated wood or full sawn timber members but may also be of any suitable material to properly support and transfer structural loads, such as illustrated in Example 3.

Figure 3:
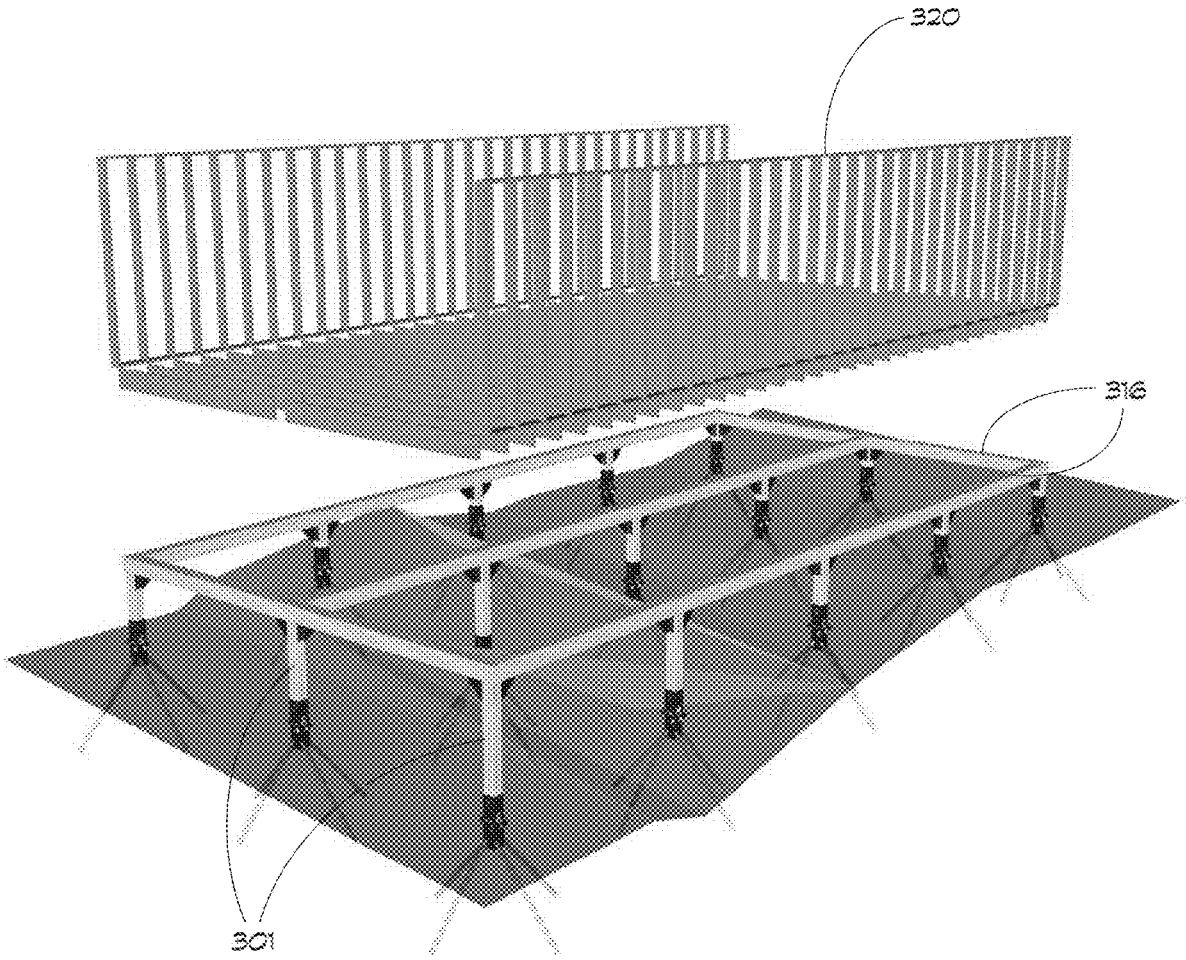
FIG. 3 is an image of multiple integral foundation columns (301) supporting continuous horizontal sill beams (316) providing the appropriate shape, seat, and attachment means for supporting a building's structural frame (320).

Example 3: Combination of Multiple Integral Foundation Components and a Structural Support (System) Frame Comprised of Multiple Beams to Support Load from a Building This exemplary embodiment is illustrated in FIGS. 3 and 4. FIG. 3 shows multiple integral foundation columns (301) supporting continuous horizontal sill beams (316) providing the appropriate shape, seat, and attachment means for supporting a building's structural frame (320).

FIG. 4 shows a front view of a foundation integral beam support component (401) installed in a suitable soil (402). The beam support component is a rectangular structural steel tube engaged with multiple driven piles (403) through elliptical holes (404) cut in the tube and incorporating an internal locking plate (e.g., (405) in FIG. 4A) as described for example in U.S. Pat. No. 5,395,184, incorporated by reference herein.

Micro-piles driven through the support tube and internal locking plate, and into the soils, provide structural support in bearing, uplift, rotational, shear and lateral loads. In this embodiment an odd number of piles of differing diameter may also be used, passing substantially below and aligned with the load axis of the structure to be supported above. Such a pile group (FIG. 4B) would be "balanced", such that a single large diameter battered pile's soil surface contact area (406) is approximately the same as the smaller diameter pair of piles (407) battered in the opposite direction.

Example 4: Beam Support System Over Battered Pile Bearing Soil

Figure 5:
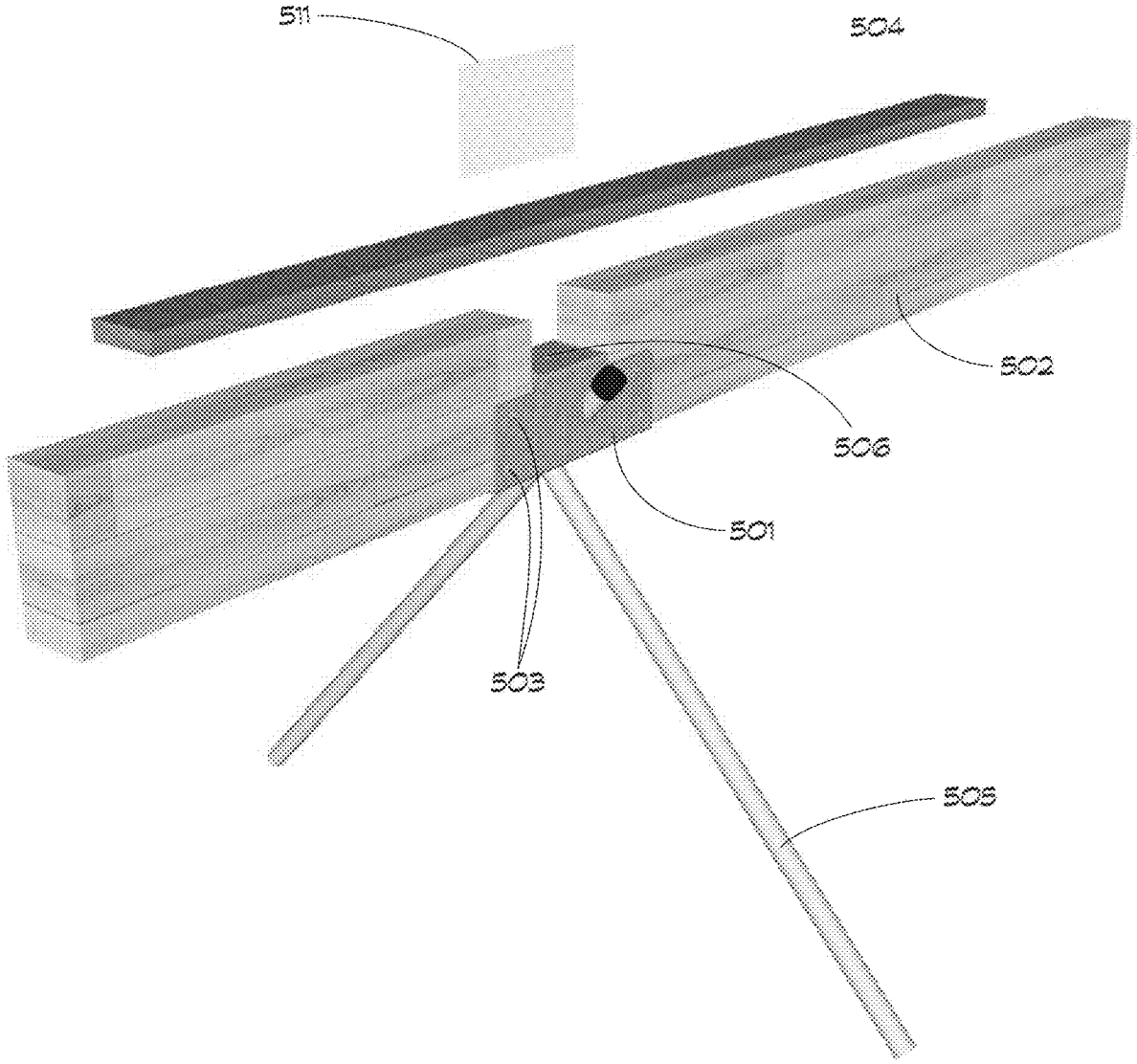
FIG. 5 illustrates an embodiment in which the beam support component (501) is set substantially level on blocks/shims over a suitable battered pile bearing soil. In this embodiment, prior to driving piles, the wood beam members (502) are set within the support component and attached with screws or bolts through holes in the support tube (503). Once leveled (with blocking/shims) and properly aligned, a sill tie (504) is secured across the top of the beams below and fastened with screws or bolts. Once this frame configuration is set, squared and secured with temporary bracing (not shown), the micro piles (505) are driven, and the locking plate is tightened to bind the piles against their corresponding elliptical holes in the tube.

This exemplary embodiment is illustrated in FIG. 5 which shows that in installation, the foundation integral beam or foundation integral saddle support component (501) is set substantially level on blocks/shims over a suitable battered pile bearing soil. In this embodiment, prior to driving piles, wood beam members (502) are set within the foundation component and attached with screws or bolts through holes in the steel tube (503). Once leveled (with blocking/shims) and properly aligned, a wood sill tie (504) is secured across the top of the beams below and fastened with screws or bolts. Once this frame configuration is set, squared and secured with temporary bracing (not shown), the micro piles (505) are driven, and the locking plate is tightened to bind the piles against their corresponding elliptical holes in the tube.

As with FIG. 1, the internal locking plate is supported within the steel tube in a specific location to facilitate easy sliding of the various piles, and tightened against them, by a tightening bolt which passes through a bolt hole (506) in the top of the tube. Tightening of the bolt and the consequent binding of the piles is achieved by tightening the nut reached through the gap created by the supported beams and sill tie above (510). This gap also functions as a ventable area for the enclosed foundation space and may be covered with a screen (511) or similar material with sufficient openings to allow air flow.

Example 5: Beam or Saddle Systems Over Battered Pile Bearing Soil

Figure 6:
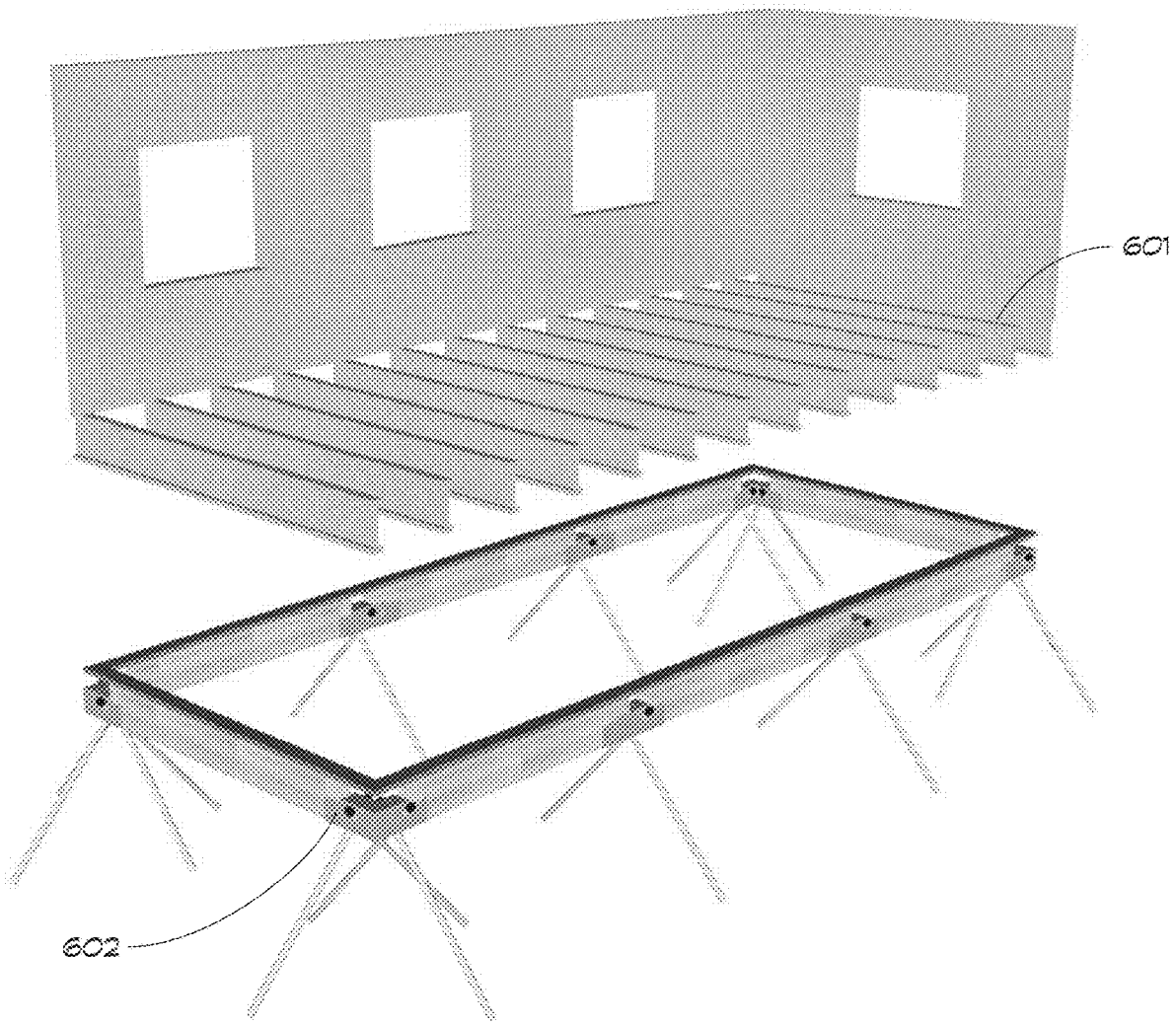
FIG. 6 illustrates an embodiment in which multiple foundation integral beam or multiple foundation integral saddle supports and associated horizontal beams and sill ties provide the appropriate shape, seat, and attachment means for supporting a building's structural frame (601).

This exemplary embodiment is illustrated in FIG. 6, which is an image of multiple foundation integral beam or foundation integral saddle supports and associated horizontal beams and sill ties providing the appropriate shape, seat, and attachment means for supporting a building's structural frame (601) shown above. In this embodiment, the construction site is graded substantially level, and the foundation tube is configured for corners (602) as shown. In application, any temporary bracing is removed, as well as the blocks and shims used to level the system, leaving a void below the overall continuous support frame to allow for drainage flows, or soil heave as various climates dictate.

This embodiment provides various benefits, including multiple allowable shapes, and can be made of steel or other suitable structural material without changing the essential function defined above. As with the previous art incorporated by reference, suitable soils may include any material that will provide load capacity transfer, and can be penetrated by the piles, including those that may require predrilling. The piles can be of a wide variety of cross sections and suitable materials per the prior art as well, and they may also include integral deformations (115) or turnings (117), on their surface or internally, which either improve driving, or load resistance or both, as shown for example in FIG. 1B.

The multiple pile group may (i) be comprised of two or more individual piles, (ii) pass substantially below the load axis of the support tube, any of which may improve the load transfer from the structure above and the performance of the pile configuration.

Example 6: Installation of a Continuous Integral Beam and Piles into Soil

Figure 7:
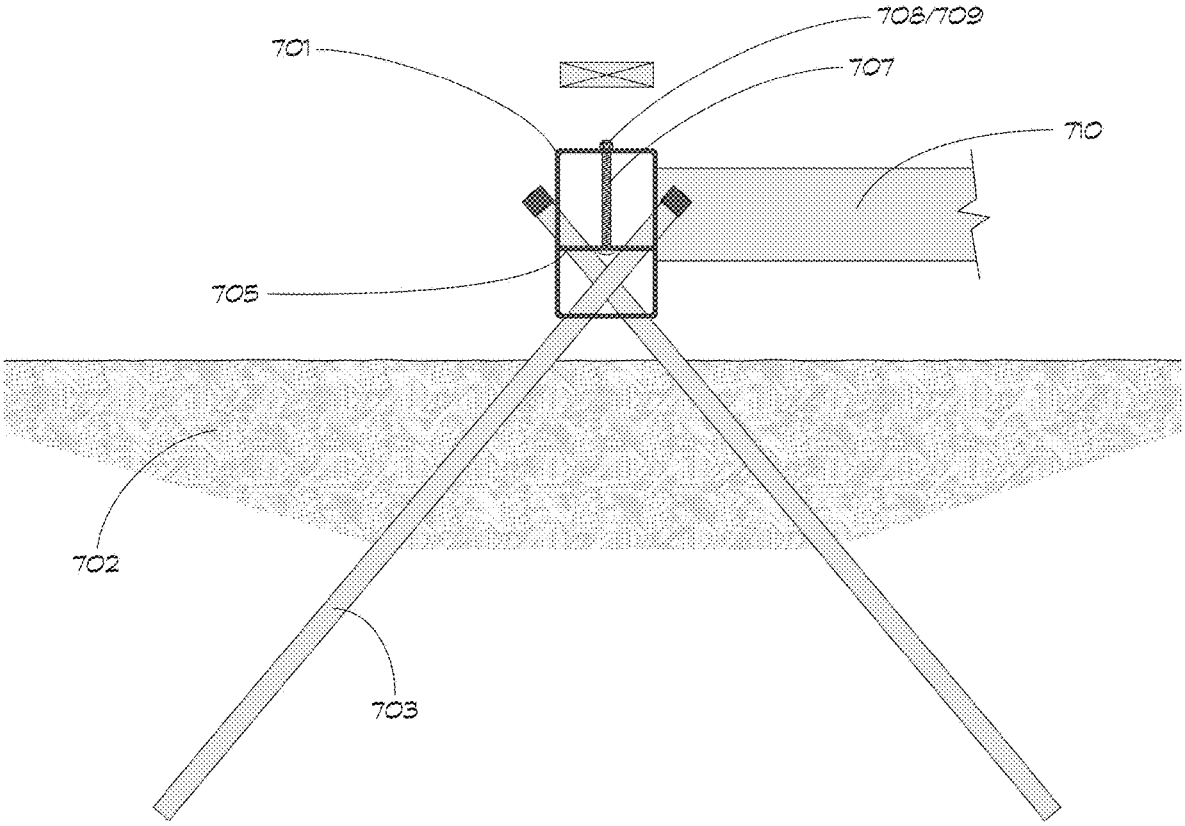
FIG. 7 is a section view of a foundation integral beam component (701) installed in a suitable soil (702). In this example, the beam component is a rectangular structural steel tube engaged with multiple driven piles (703) through elliptical holes cut in the tube, for example as illustrated in FIG. 8 of U.S. Pat. No. 5,395,184, which is incorporated by reference herein, and incorporates an internal locking plate (705), for example as illustrated in U.S. Pat. No. 8,714,881, which is incorporated by reference herein.
Figure 8:
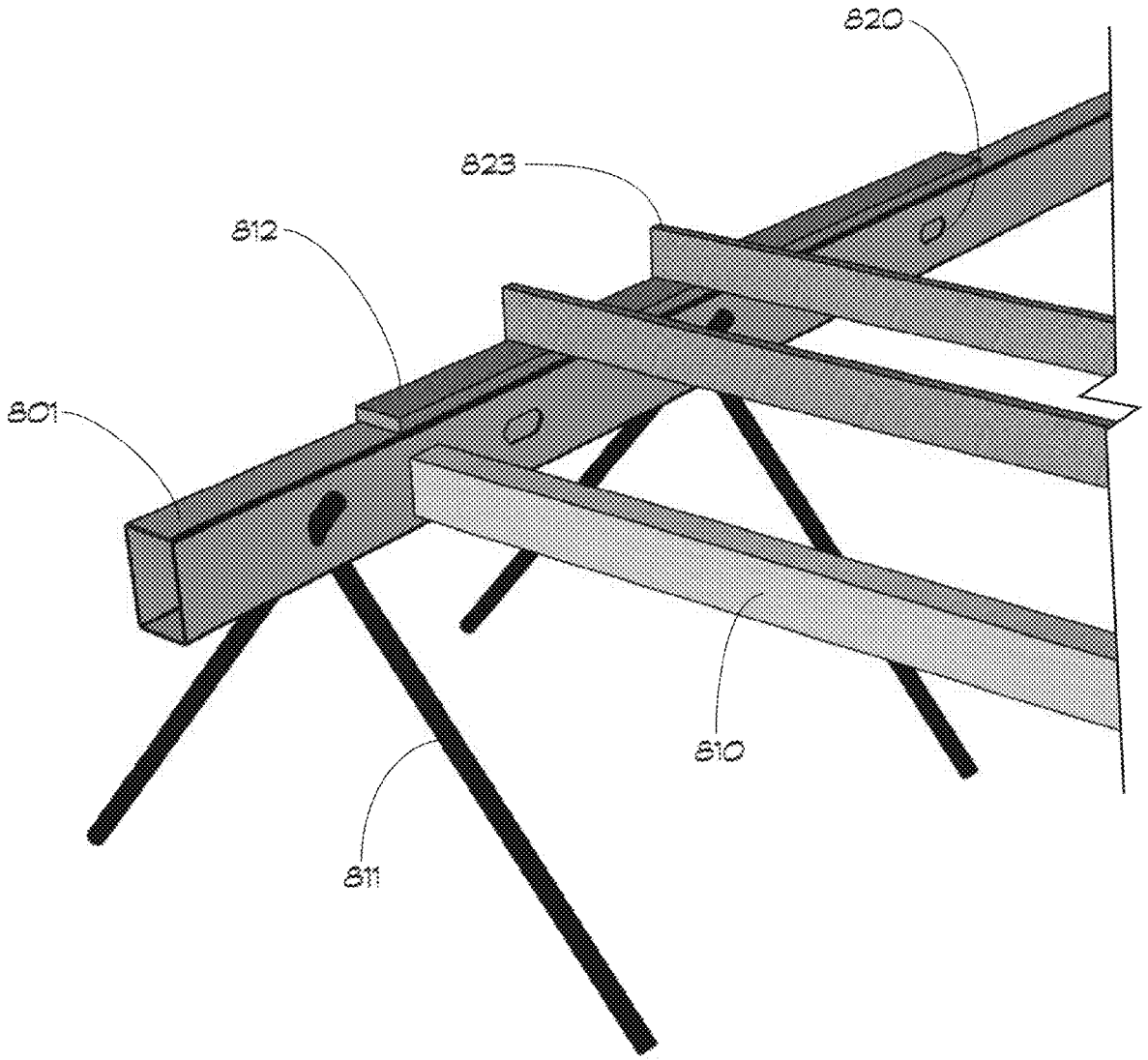
FIG. 8 is a three-dimensional view of a portion of the foundation integral beam component (801) with associated horizontal tie beam (810), driven pile pairs at regular intervals along the beam (811), a wood sill attachment (812), and wood joists (813). Access holes (820) are shown along the side of the beam, which facilitate the positioning of the locking plates and associated tightening bolts within the length of the beam during its assembly.

This exemplary embodiment is illustrated in FIG. 7, a section view of a foundation integral beam component (701) installed in a suitable soil (702). The beam component is a rectangular structural steel tube engaged with multiple driven piles (703) through elliptical holes cut in the tube, such as illustrated in FIG. 8 of U.S. Pat. No. 5,395,184, which is incorporated by reference herein, and incorporating an internal locking plate (705) as described in U.S. Pat. No. 8,714,881, which is incorporated by reference herein.

In this exemplary installation, the continuous integral beam component (701) is set level using temporary blocks and shims set on site grade substantially level. Micro-piles driven through the beam and internal locking plate (705), and into the soils, provide structural support in bearing, uplift, rotational, shear and lateral loads. Once the micro piles are driven, the locking plate is tightened to bind the piles against their corresponding elliptical holes in the beam. In the component depicted, the locking plate is supported within the tube beam in a specific location to facilitate easy sliding of the various piles by a tightening bolt (707) which passes through a hole (708) in the top of the tube beam. Tightening of the bolt and the consequent binding of the piles is achieved by tightening the nut (709). An optional horizontal tie cross-beam (710) is also shown, allowing for the connection of the tube beam to a corresponding parallel tube beam on the opposite side of the structure. The beam(s) (701) may be installed individually without this integrating cross-tie, or if tied, comprise a "whole" pre-configured frame, that is craned into a site as a complete assembly prior to leveling and the driving of micro-piles.

Example 7: Foundation Integral Beam Configured to Receive a Pile Through Opening in the Beam This exemplary embodiment is illustrated in FIG. 8, which is a three-dimensional view of a portion of the foundation integral beam component (801) with associated horizontal cross-tie beam (810), driven pile pairs at regular intervals along the beam (811), a wood sill attachment (812), and wood joists (813). Access holes (820) are shown along the side of the continuous beam, which facilitate the positioning of the locking plates and associated tightening bolts within the length of the beam during its assembly. In certain applications, the driven piles can also be spaced irregularly or on specific alignment in certain applications so as to support individual point loads from the structure above, as shown for example in FIG. 9.

Figure 9A:
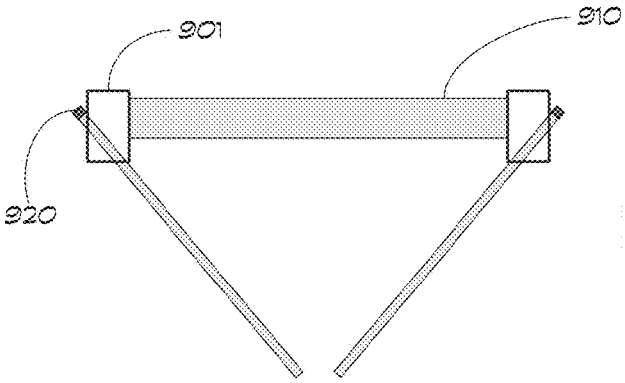
FIG. 9A illustrates an embodiment in which single opposing single piles (920) in parallel beams (901) may be utilized if they are driven from outside the configuration and provided that the horizontal beam ties (910) are secured sufficiently to the beams so as to properly restrain the main beams under an outward rotational force.

FIG. 9 is a three-dimensional view of an embodiment with two horizontal beam components configured to support a building frame structure (902), where the pile groups (911) are aligned with column point loads (903) from the building structure above. An additional tube beam component (914) is also shown, running perpendicular to the two main beams, closing off the frame. These beams are joined with a mitered connection at the corners (915) which can be welded or bolted to secure. In the exemplary embodiment illustrated in FIG. 9A, opposing single piles (920) in parallel beams (901) may be utilized, and driven from outside the support configuration, provided the horizontal beam cross-ties (910) are used, and secured sufficiently to the tube beams to properly restrain the tube beams under an outward rotational force.

Figure 9B:
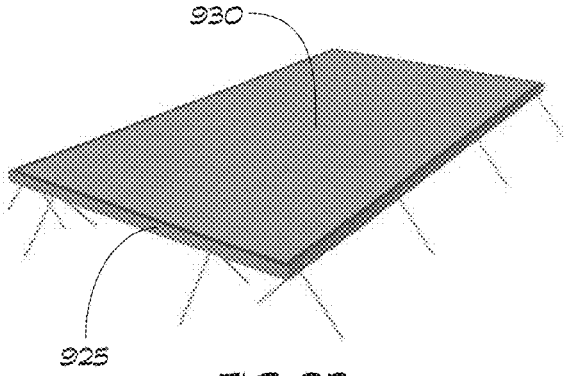
FIG. 9B illustrates that beams may also be installed to provide a complete continuous perimeter (925), that in some applications would also allow for poured internal concrete slab (930).

As shown in FIG. 9B, the tube beams may also be installed to provide a complete continuous perimeter (925), that in some applications would also allow for poured internal concrete slab (930).

These beam components provide various benefits. These benefits include, but are not limited to, provision of multiple allowable shapes. The beams can be made of steel or other suitable material without changing the essential function defined above. As with the previous art incorporated by reference, suitable soils may include any material that will provide a load capacity transfer and can be penetrated by the micro-piles, including those that may require predrilling. The piles can be of a wide variety of cross sections and suitable materials per the prior art as well, and they may also include integral deformations (115) or turnings (117), on their surface or internally, which either improve driving, or load resistance or both, as shown in FIG. 1B.

The piles can pass substantially below the load axis of the beam so as to improve the load transfer from the structure above and the performance of the pile configuration.

Example 8: Plate Component Configuration

Figure 11:
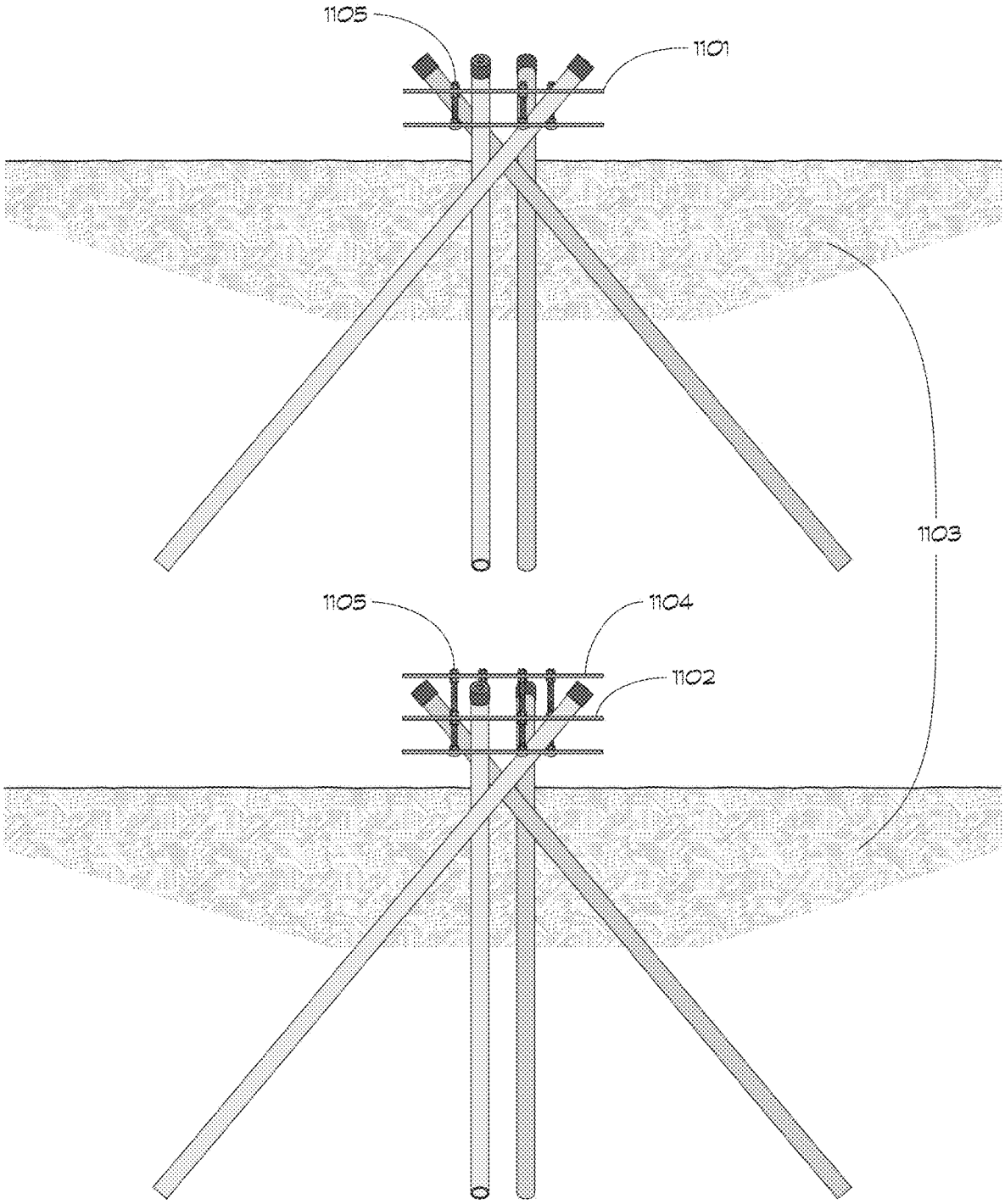
FIG. 11 illustrates an embodiment with a front view of a foundation integral plate components (1101 and 1102) installed above suitable soils (1103). Plate component (1102) depicts an additional leveling plate (1104) above, and attached by extended tightening bolts (1105), set with nuts above and below the additional plate. In application this allows for the double plate component (1102) to be installed and tightened on the driven piles without concern for exact level, as the additional third plate (1104) can be adjusted to exact level and provide the connection means to a structural component above.
Figure 11A:
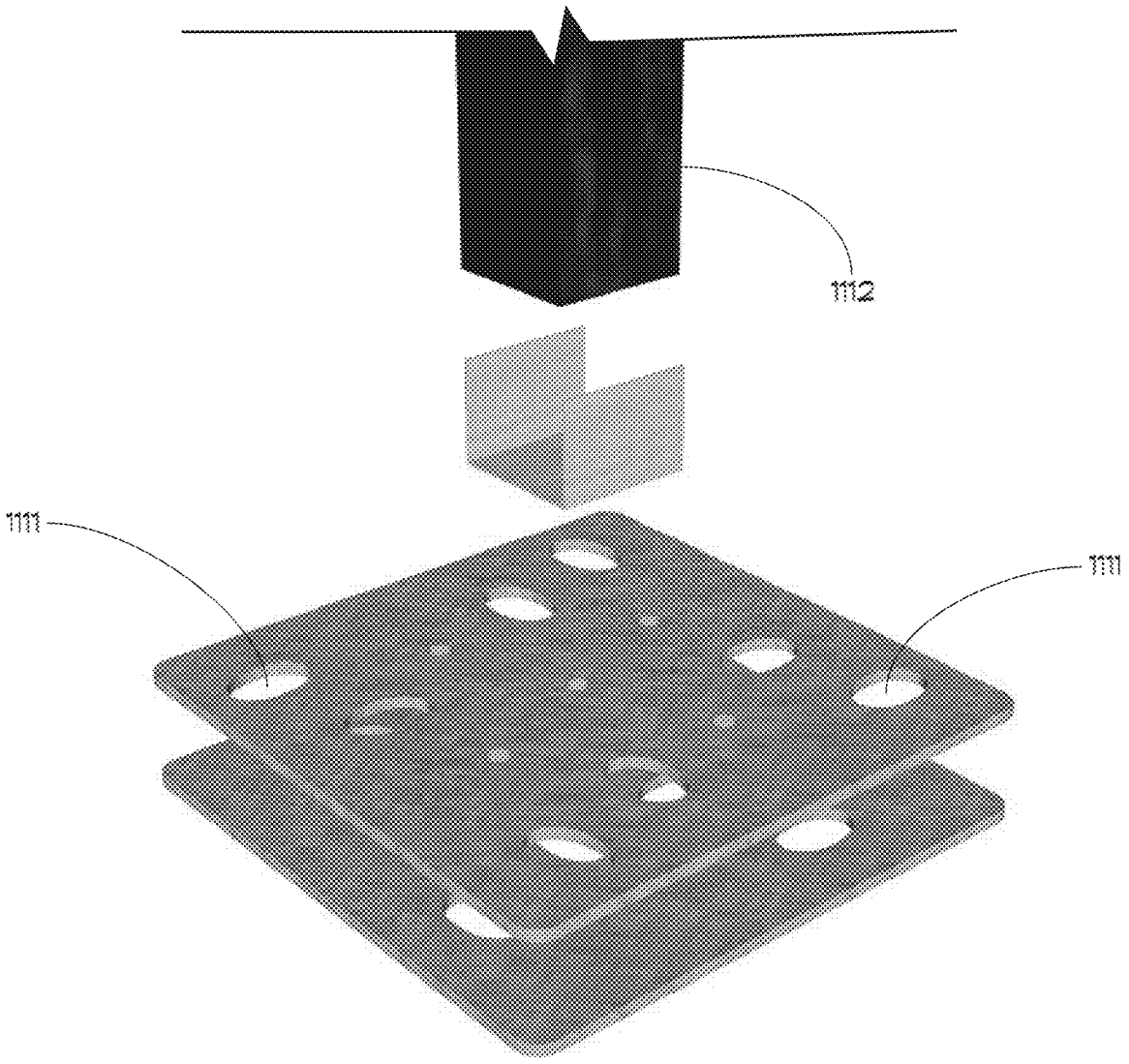
FIG. 11A illustrates an embodiment in which the plates of FIG. 11, but with additional pile openings (1111) allowing for increased pile count and corresponding load capacity increase. Piles passing through elliptical openings in the plates, again, are configured to run substantially below the load axis of the structural component above (1112).

This exemplary embodiment is illustrated in FIGS. 11 and 11A. FIG. 11 provides a front view of foundation integral plate components (1101 and 1102) installed above suitable soils (1103). The configuration may be adjusted (by blocks/shims not shown) to increase or decrease the distance between bottom plate and top of soil. The plate components can be any number of configurations described in U.S. Pat. No. 8,714,881, incorporated by reference herein. Plate component (1102) depicts an additional leveling plate (1104) above, and attached by extended tightening bolts (1105), set with nuts above and below the additional plate. In application this allows for the double plate component (1102) to be installed and tightened on the driven piles without concern for exact level, as the additional third plate (1104) can be adjusted to exact level and provide the connection means to a structural component above, as shown in FIG. 11A.

FIG. 11A shows the plates of FIG. 11, but with additional pile openings (1111) allowing for increased pile count and corresponding load capacity increase. It is noted that piles passing through elliptical openings in the plates, again, are configured to run substantially below the load axis of the structural component above (1112). It is understood however that piles set further and further from the load axis or center of a given plate assembly may increase the lateral and rotational stability of the overall foundation, but that in such a configuration, the plate assembly is subject to rotation around a horizontal plane corresponding to the uniform driven direction of all the piling, which may increase vertical settling under load.

The illustrated components provide various benefits. Such benefits include multiple allowable plate shapes. Any of the components can be made of steel or other suitable material without changing the essential function defined above. As with the previous art incorporated by reference, suitable soils may include any material that will provide a load capacity transfer and can be penetrated by the piles, including those that may require predrilling. The piles can be of a wide variety of cross sections and suitable materials per the prior art as well, and they may also include integral deformations (115) or turnings (117), on their surface or internally, which either improve driving, or load resistance or both, as shown in FIG. 1B.

Figure 12:
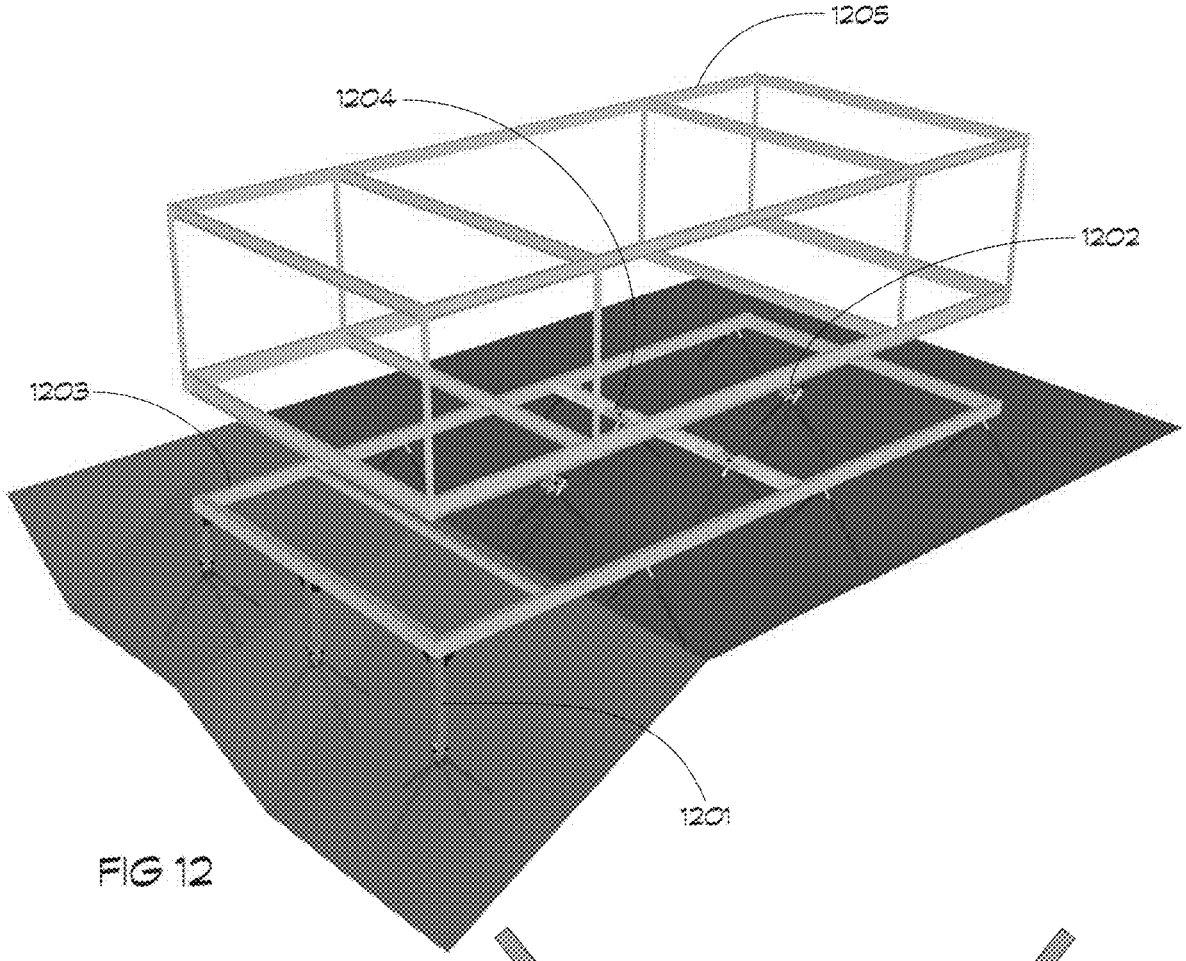
FIG. 12 illustrates a combination of a number of the foundation integral embodiments, e.g., foundation integral columns (1201), foundation integral plates (1202), foundation integral beam supports (1204), and foundation integral beams (1203), providing the appropriate shape, seats, and attachment means for supporting a building's structural frame (1205)
Figure 12A:
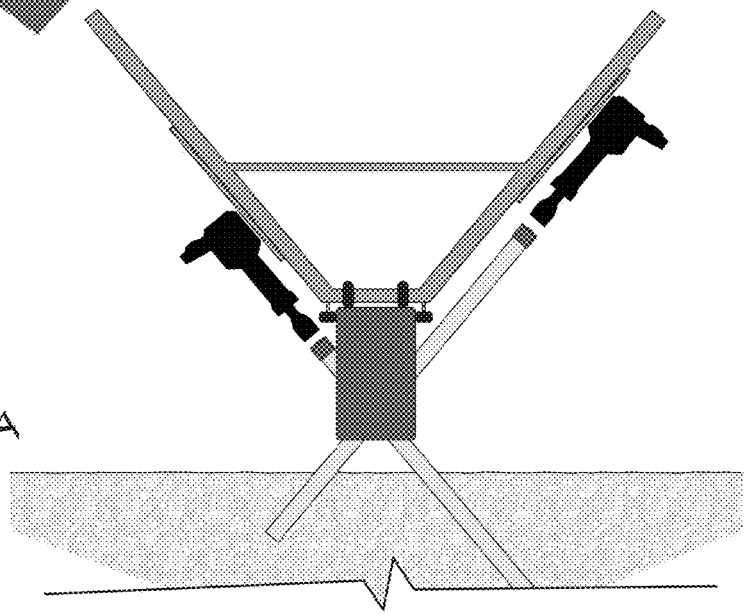
FIG. 12A illustrates an embodiment in which any of the resulting horizontal beams created by embodiments herein can be adapted to support a sliding drill/driving tool for the installation of the micro-piling.

Example 9: Configuration of Building Structural Support, Foundation, Beam or Saddles and with Foundation Integral Column, Foundation Integral Plates, and Foundation Integral Beams This exemplary embodiment is illustrated in FIGS. 12 and 12A. FIG. 12 is an image of the application in combination of a number of the embodiments—foundation integral columns (1201), foundation integral plates (1202), foundation integral beam supports (1204), and foundation integral beams (1203), providing the appropriate shape, seat, and attachment means for supporting a building structure (1205). The structure may embody of any of the various constructions methods now available or to become available, such as site-built or prefabricated frames, in steel or wood, panelized construction including panelized floor, wall or roof assemblies—in steel wood or pre-cast concrete—post and beam structures, fully pre-fabricated structures delivered and slid or craned into place, and other similar variations.

As illustrated in FIG. 12A, any of the resulting horizontal beams created by the embodiments herein, can be adapted to support a sliding drill/driving tool for the installation of the micro-piling. The micro-piles can be of varying cross-sectional shapes and structural materials, and, in steel, can be raw, galvanized or powder coated depending on durability requirements of a given project and/or site.

The plurality of piles or micro-piles can be configured in clusters including a number of varying cross-sectional shapes, designs, and structural materials. The plurality of piles or micro-piles shapes and or designs can include hollow piles. The plurality of piles or micro-piles can improve the soil condition. The plurality of piles and micro-piles clusters can be configured to generally improve the soil condition by providing soil stabilization. The plurality of pile or micro-piles clusters can be configured to provide for soil moisture venting including through the pile or micro-pile's hollow shape. The plurality of piles and micro-piles clusters can also improve the soil condition through soil moisture venting.

The descriptions contained herein are examples of embodiments of the invention and are not intended in any way to limit the scope of the invention. As described herein, the invention contemplates many variations and modifications of the foundation system. These modifications would be apparent to those having ordinary skill in the art to which this invention relates and are intended to be within the scope of the claims which follow.

Patents, patent applications, publications, product descriptions, and protocols are cited throughout this application, the disclosures of which are incorporated herein by reference in their entireties for all purposes.

What is claimed is:

1. A structural support system comprising:

a plurality of foundation components configurable in spaced locations to engage and support a surface structure, wherein each foundation component comprises:

(a) a selectively shaped rigid housing providing strength sufficient to support and transfer loads associated with said surface structure and configured to engage one or more beams or columns forming a connection to said surface structure;

(b) one or more aligned pairs of selectively positioned openings in said rigid housing each pair of openings configured to receive and engage with at least one elongated pile at a pre-selected angle relative to said surface structure, and;

(c)) a multi-position locking plate connected to said rigid housing and capable of being adjusted to a locked position that applies a compressive force against said at least one elongated pile that extends through an opening in said locking plate.

2. The structural support system of claim 1, wherein said multi-position locking plate comprises separate openings for at least two piles.

3. The structural support system of claim 1, wherein said multi-position locking plate is positioned to engage said at least one pile between the one or more aligned pairs of selectively positioned openings in each foundation component.

4. The structural support system of claim 1, further comprising a bracing connector configured to connect each foundation component to the one or more beams or columns.

5. The structural support system of claim 1, wherein said multi-position locking plate is formed of a rigid metal.

6. The structural support system of claim 1, wherein the structural support system distributes a structural load onto the plurality of the foundation component and at least one pile.

7. The structural support system of claim 1, wherein a quantity, positioning, and location of the plurality of the foundation components and a number, a positioning, and a location of the one or more beams or columns are determined by a distribution of a structural load.

* * * * *